US006727642B1

(12) United States Patent
Cho et al.

(10) Patent No.: US 6,727,642 B1
(45) Date of Patent: Apr. 27, 2004

(54) FLAT FIELD EMITTER DISPLAYS

(75) Inventors: Gyu Hyeong Cho, Taeson (KR); Nam Sung Jung, Wonjoo-si (KR); Gyun Chae, Taejon (KR); Tae Ha Ryoo, Taejon (KR); Jon Woon Hong, Pusan-si (KR); Seung Tak Ryu, Taejon (KR); Young Ki Kim, Suwon-si (KR)

(73) Assignee: Korea Advanced Institute of Science & Technology, Taejon-si (KR)

( * ) Notice: Subject to any disclaimer, the term of this patent is extended or adjusted under 35 U.S.C. 154(b) by 0 days.

(21) Appl. No.: 09/646,730

(22) PCT Filed: Mar. 22, 1999

(86) PCT No.: PCT/KR99/00125

§ 371 (c)(1),
(2), (4) Date: Oct. 6, 2000

(87) PCT Pub. No.: WO99/49492

PCT Pub. Date: Sep. 30, 1999

(30) Foreign Application Priority Data

Mar. 21, 1998 (KR) ..... 98-9816
Mar. 17, 1999 (KR) ..... 1999-8923

(51) Int. Cl.[7] ..... H01J 1/62; H01J 1/30

(52) U.S. Cl. ..... 313/496; 313/497; 313/113; 313/309; 313/292

(58) Field of Search ..... 313/495, 496, 313/497, 309

(56) References Cited

U.S. PATENT DOCUMENTS 4,940,916 A * 7/1990 Borel et al. ..... 313/306
5,258,685 A * 11/1993 Jaskie et al. ..... 313/309
5,378,963 A * 1/1995 Ikeda ..... 313/103 CM
5,578,225 A * 11/1996 Chien ..... 216/24
5,965,971 A * 10/1999 Karpov ..... 313/309
6,023,126 A * 2/2000 Karpov ..... 313/309
6,133,690 A * 10/2000 Meyer et al. ..... 313/309
6,313,572 B1 * 11/2001 Yamada ..... 313/306
6,333,598 B1 * 12/2001 Hsu et al. ..... 257/10
6,340,859 B1 * 1/2002 Lee et al. ..... 257/10

FOREIGN PATENT DOCUMENTS

EP 0 406 886 1/1991
EP 0 501 785 9/1992

OTHER PUBLICATIONS

Patent Abstracts of Japan, Publication No. 09–237568, published Sep. 9, 1997 for Electron Emitting, Electton Source, Image Forming Device Using it, and Characteristic Recovery Method.

* cited by examiner

*Primary Examiner*—Ashok Patel
*Assistant Examiner*—Glenn D. Zimmerman
(74) *Attorney, Agent, or Firm*—Bachman & LaPointe, P.C.

(57) ABSTRACT

Disclosed are flat panel field emitter displays whose unit cell structure adopt a planar cathode structure in stead of a conventional microtip structure, so as to increase the degree of integration and can be operated at low operation voltages at high speeds. In the structure, a channel insulator is formed below the cathode and underlaid by a gate. By means of the gate voltage, the electron emission from the cathode can be controlled. The electrodes in the structure are arranged in the order of anode, cathode and gate, allowing the simplification of processes. With the ease of controlling the distance between electrodes, the displays can be applied for almost all video systems from small sizes to large screen area displays, in place of conventional displays. The displays allows conventional semiconductor processes and facilities to be utilized as they are.

14 Claims, 14 Drawing Sheets

FLAT FIELD EMITTER DISPLAYS

BACKGROUND OF THE INVENTION

1. Field of the Invention

The present invention relates to flat panel displays which can be operated at a low voltage on the basis of vacuum tunneling, thereby realizing a long life and uniformity.

2. Description of the Prior Art

The most widely popularized display in the world is the cathode ray tube (CRT). Recently, however, the increasing desire to represent images more largely and sharply has led attention to be paid to flat panel displays. Examples of conventional flat panel displays include liquid-crystal displays (LCDs), electroluminescent displays (ELDs), field-emission displays (FEDs), plasma display panels (PDPs), vacuum fluorescent displays (VFDs), flat panel CRTs and light emitting diodes (LEDs).

Of these flat panel displays, LCDs are the most prevailing, and FEDs are a strong competitor in the flat panel display market currently dominated by LCD manufacturers. Typically, an LCD consists of cell structures, in each of which a phosphor-coated front member is combined with a cathode emitter-equipped backing member with a predetermined vacuum spacing therebetween. If a potential ranging from hundreds to tens of thousands of volts is applied across the front member and the backing member, electrons are emitted from the electron emitter and collide against the phosphor coating to make luminescence.

Referring to FIG. 1, there is a cell structure for a pixel of a conventional FED employing a microtip type vacuum transistor. As shown in this figure, this conventional FED cell structure is composed of a front panel structure 1 and a backing panel structure 2, the front panel structure 1 comprising a front panel 3 underlaid with a transparent anode 4 whose bottom is coated with a phosphor 5, the backing panel structure 2 comprising a backing panel 6 on which a cathode 9 with a tip t, an insulating layer 8 and a gate electrode 7 are sequentially formed.

When a strong electric field is applied between the cathode 9 and the gate 7, electrons are quantum-mechanically emitted from the metal surface of the cathode tip t, then accelerated by the high voltage applied to the transparent anode 4, and finally collide against the phosphor coating 5 on the anode 4 to emit light.

To accomplish proper emission of free electrons from a metal surface in a vacuum, an electric field of 0.5 V/or higher is required. For this, the diameter of the gate which surrounds the electron emission spot centering around the metal cathode tip must be much smaller than 1 $\mu$m. The production of such a microtip as in the FED must be based on a photolithography process with which a resolution of 1 $\mu$m or less can be attained and maintained. Where the semiconductor production techniques in current use, which have been significantly advanced, and the production techniques for other displays are combined, the microtip can be manufactured, but in a small scale. Much time is still needed for establishing a complete process by which the microtip can be mass produced.

Apart from the spacing between the electrodes and the formation of the sharp-pointed electron emitter, a material which is stable and has a low work function is required for a successful FED. Such a stable and low work function material allows a low operation voltage for the display. Many research reports on microtips using such metals as molybdenum (Mo) and tungsten (W) have been published. Molybdenum are tungsten show an advantage of being mechanically stable, but are disadvantageous in that they have a large work function and show a limitation in reducing the curvature radius at the end of the tip. Thus, the FEDs employing the metals are still high in operation voltage.

Recently, microtips have been developed in various aspects, including surface treatment of microtips to reduce the work function and employment of low work function materials such as diamond like materials.

However, the FEDs using the microtips under current research in current suffer from disadvantages in that:

First, the tips are damaged by ion sputtering during operation.

Second, the microtips are difficult to produce. The electron emission efficiency in an FED has a direct influence on its luminance and resolution. So, the structure and construction process of the micro tip, the structural optimization associated with the shapes and spacings of electrodes, and the selection of electron emitting materials, which all play critical roles in determining the electron emission efficiency, are very important. However, technical difficulties still remain on the current construction processes of the microtip. The spacing between electrodes and production methods thereof also provide another technical difficulty.

Third, it is difficult to accomplish spacial uniformity. The microtips do not easily attain uniformity even by the same process procedure. Since each pixel consists of a plurality of unit cells, the presence of a few bad cells does not critically affect the function of the cell. However, if the microtips are nonuniform among the pixels, the image realized on the display is not stable.

Fourth, flickering takes place.

Fifth, arc discharge occurs owing to the high electric field between the gate and the cathode tip, breaking the gate and/or the cathode tip. In practice, during processing or operating, the vacuum degree may be decreased. In addition, because the spacing between the electrodes is very narrow, if impurities such as heterogeneous metal atoms are deposited between the electrodes, arc discharge easily arises.

Finally, arc discharge may also occur between the gate and the anode even though they are apart from each other at a relatively long distance. Despite this condition, the high voltage which is applied to the anode to accelerate the electrons emitted from the microtips, may cause arc discharge.

Much advance has been made on the above mentioned technical subjects. However, the problems are attributed fundamentally to the presence of the microtips.

SUMMARY OF THE INVENTION

Therefore, it is an object of the present invention to overcome the above problems encountered in prior arts and to provide a novel flat panel field emitter display, which has a planar unit cell structure and thus, allows a high degree of integration.

It is another object of the present invention to provide novel flat panel field emitter display, which is able to realize images of high definition and fast response, and represent all natural colors with a high resolution.

As a result of the intensive and thorough research repeated by the present inventors, a novel flat panel field emitter display which meets the above conditions, was developed and named "KAIST Field Emitter Display" (hereinafter referred to as "KFED").

In accordance with an aspect of the present invention, there is provided a double panel type flat field emitter display, consisting of a plurality of unit cells, each cell comprising: a front panel structure in which an anode is formed on a transparent front panel and coated with a phosphor; and a backing panel structure in which a cathode and a gate are formed on and beneath a channel insulator underlaid by a backing panel, the front panel structure being joined to the backing panel structure in a vacuum condition in such a way that the phosphor faces toward the cathode, wherein a low voltage is applied between the gate and the cathode to emit electrons from a spot at which the fringe of the cathode is in contact with the channel insulator, to the vacuum channel, and a high voltage is applied to the anode to accelerate the emitted electrons and finally to collide them against the phosphor to luminesce, said emitted electrons being controlled in number by the voltage between the gate and cathode, said cells being arranged in a pattern to form a pixel which represents information.

BRIEF DESCRIPTION OF THE DRAWINGS

The above and other objects and aspects of the invention will become apparent from the following description of embodiments with reference to the accompanying drawings in which.

DETAILED DESCRIPTION OF THE PREFERRED EMBODIMENTS

Figure 1:
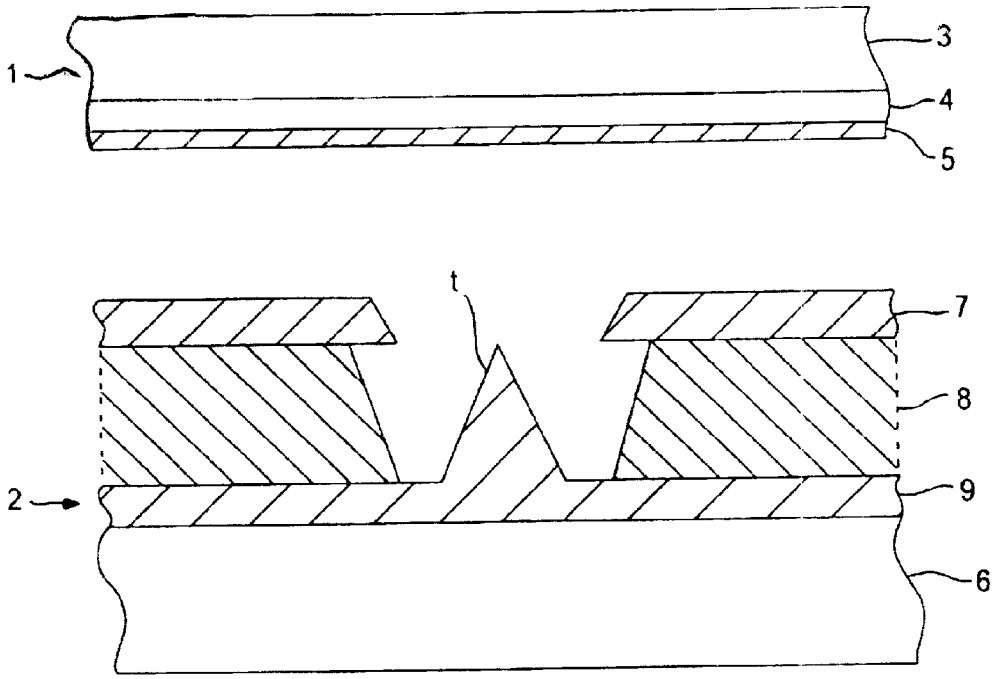
FIG. 1 PRIOR ART
FIG. 1 is a schematic cross sectional view showing a unit cell structure of a conventional FED.

The application of the preferred embodiments of the present invention is best understood with reference to the accompanying drawings, wherein like reference numerals are used for like and corresponding parts, respectively.

Figure 2A:
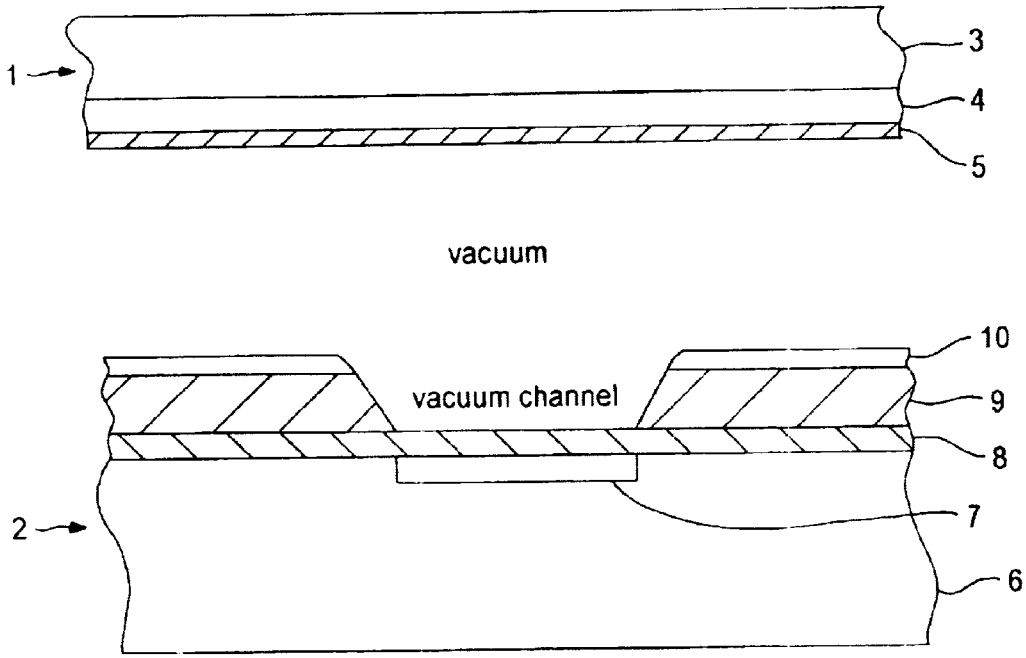
FIG. 2*a* is a schematic cross sectional view showing a unit cell structure of a KFED.

Referring to FIG. 2*a*, there is shown a cell structure for an FED according to a preferred embodiment of the present invention, in a cross sectional view. As shown in this figure, the cell structure is composed of a front panel structure 1 and a backing panel structure 2. The backing panel structure 2 comprises a backing panel 6 on which a channel insulator 8 is entirely covered and a cathode 9 coated with an insulating protective film 10 is selectively formed, with a gate 7 positioned beneath the channel insulator 8. The gate 7 functions to control electron emission. The front panel structure 1 comprises a front panel 3 underlaid with a transparent anode 4 whose bottom is coated with a phosphor 5. To the transparent anode 4, a positive voltage is applied, accelerating the emitted electrons to collide against the phosphor screen 5 to luminesce.

Figure 2B:
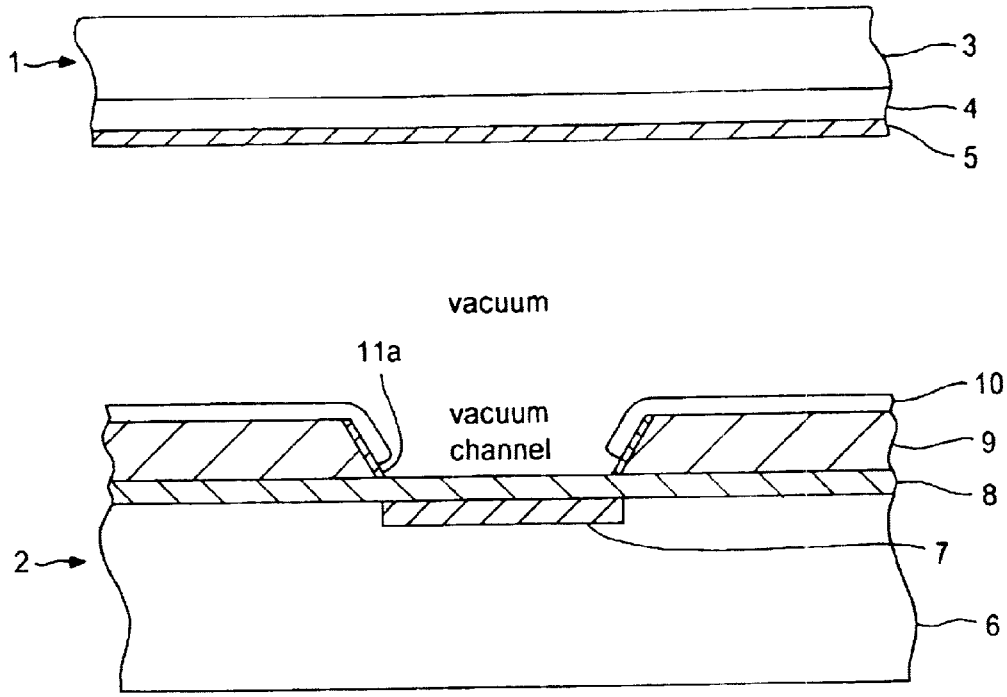
FIG. 2*b* is a schematic cross sectional view illustrating the application of a low work function material to a cathode in the unit cell structure of the KFED of FIG. 2*a;*

Referring to FIG. 2*b*, there is shown a cell structure for an FED according to another preferred embodiment of the present invention. This structure is based on the structure of FIG. 2*a*. As shown, a low work function material 11*a* featured in a low work function and excellent mechanical properties, is coated on the cathode in the electron emission region, so as to yield high electron emission efficiencies at low operation voltages while the insulating protective film 10 is extended to cover the low work function material 11*a*, except for the electron emission spot, so as to prevent electrons from being emitted directly from the low work function material 11*a* upon the application of a high voltage to the anode 4. In the drawings hereinafter suggested in the invention, the cathode is coated with the low work function material, but the cathode metal may be subjected to surface treatment to lower its work function.

Figure 2C:
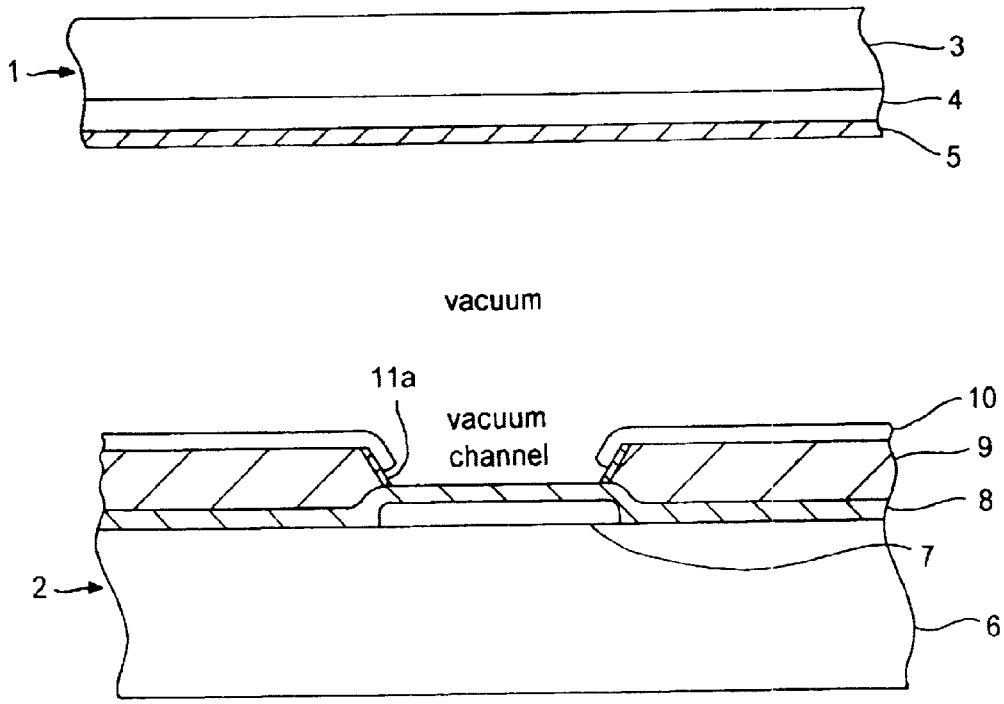
FIG. 2*c* shows a modified example of the unit cell structure of FIG. 2*b*, convenient in an aspect of fabrication process.
Figure 2D:
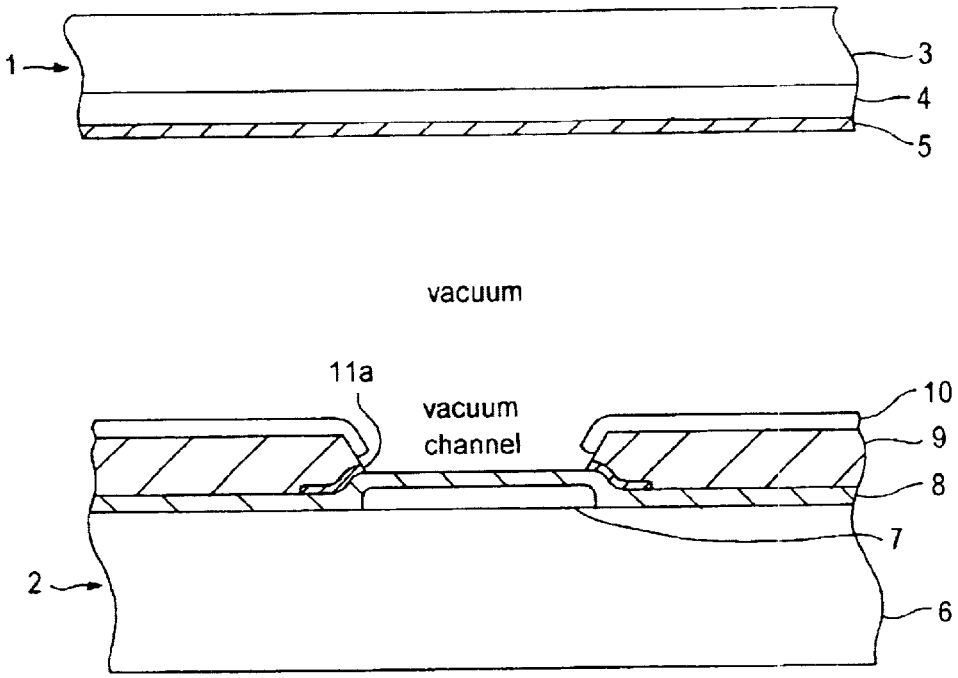
FIG. 2*d* is a schematic cross sectional view illustrating the application of a low work function material between a cathode and a channel insulator in the unit cell structure of the KFED of FIG. 2*c;*

Referring to FIG. 2*c*, there is shown a cell structure for a FED according to a further embodiment of the present invention. This structure is a modified form of the structure of FIG. 2*a* or 2*b* for the convenience of fabrication. As seen, a gate 7 is formed on a backing panel 6, followed by the formation of a channel insulator 8 over the resulting structure. Then, a cathode 9 is constructed on the channel insulator 8. The drawings to be illustrated later are based on FIG. 2*a* or 2*b*, but may be applied with the structure of FIG. 2*c*. Referring to FIG. 2*d*, there is shown a cell structure for a FED according to another embodiment of the present invention. This structure is the same as the structure of FIG.

2*c*, except that a low work function material 11*a* is applied between the cathode 9 and the channel insulator 8.

Figure 3:
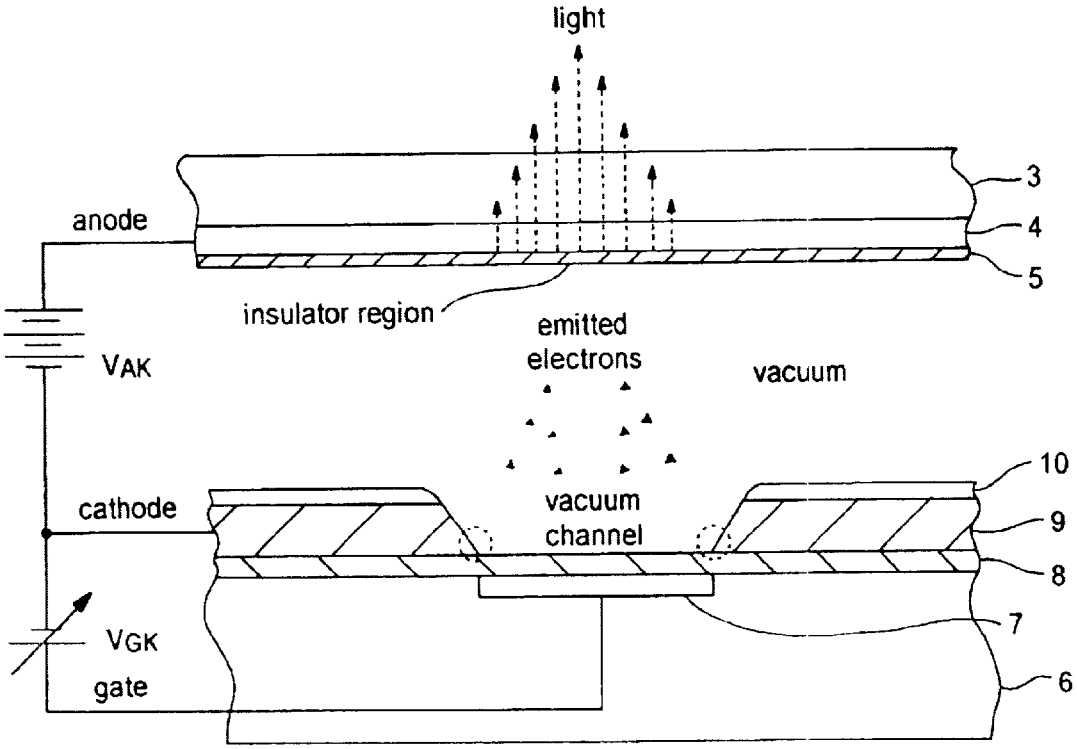
FIG. 3 illustrates the concept of the electron emission and luminescence in the unit cell structures of FIGS. 2*a* to 2*c;*

With reference to FIG. 3, the operation procedure in the flat panel FED according to the present invention is described.

First, when a voltage ($V_{GK}$) is applied across the gate 7 and the cathode 9, a strong electric field is formed through the channel insulator region between the gate 7 and the cathode 9, promoting a tunneling effect at the fringe of the cathode 9 to emit electrons therefrom to the vacuum. These emitted electrons are accelerated by the voltage ($V_{AK}$) applied to the anode to collide against the phosphor coating 5.

This flat structure according to the present invention is fabricated more simply compared to conventional microtip structures. Its fabrication can be carried out by a printing method, so a large area screen is constructed with ease. In conventional FEDs, the high voltage discharge resulting from the use of the high voltage phosphor 5 causes a flashover phenomenon, damaging the microtip. On the other hand, this problem is avoidable in the present invention because the electron emission occurs at the fringe of the cathode and thus, the electron emission spot is a circular or polygonal shape which has a considerably wider area than does the sharp-pointed microtip.

Figure 4:
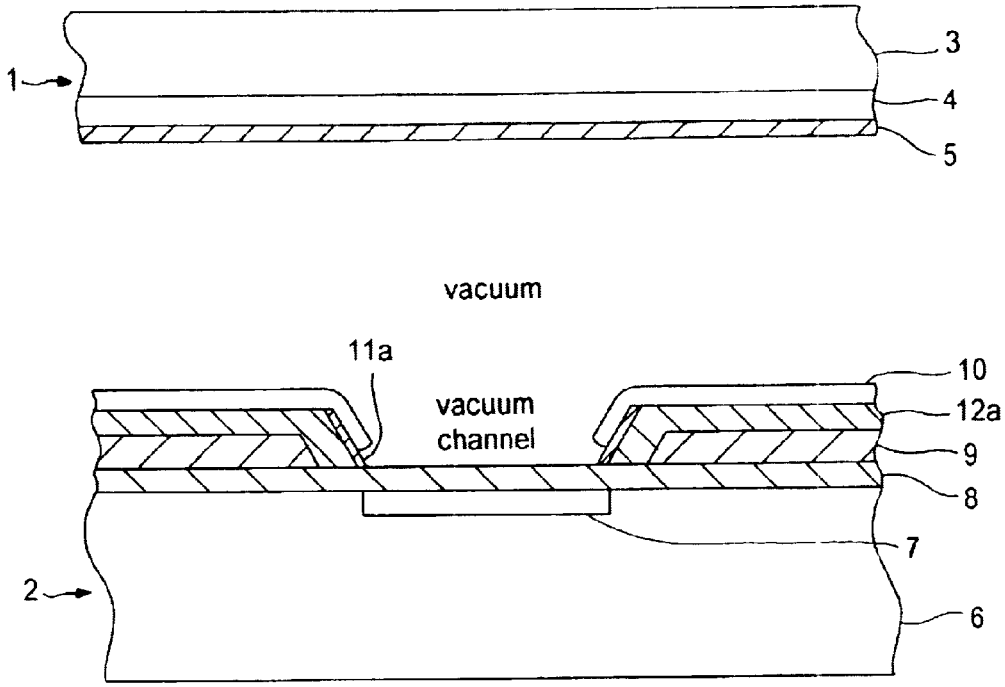
FIG. 4 illustrates an application of a resistance layer to a cathode, based on the unit cell structure of FIG. 2.

With reference to FIG. 4, there is a cell structure of the FED according to another embodiment of the present invention. It is characterized in that a cathode resistance layer 12*a* is deposited over the cathode 9 and coated with a low work function material 11*a* at the electron emission region. An insulating protective film 10 covers the exposed cathode resistance layer 11*a* and the low work function material 12*a* except for the electron emission spot. In this structure, the cathode resistance layer 12*a* acts like a load line to restrict the micro cell current attributable to the emission of numerous electrons. The presence of this flat cathode resistance layer contributes to an enhancement in the uniformity of electron emission. In addition, the cathode resistance layer 12*a* functions to restrain the maximal current which can flow at a short circuit when a voltage is applied between the cathode 9 and the gate 7, so that much more normal cells than the short cells can operate, giving rise to an increase in the production yield.

Figure 5:
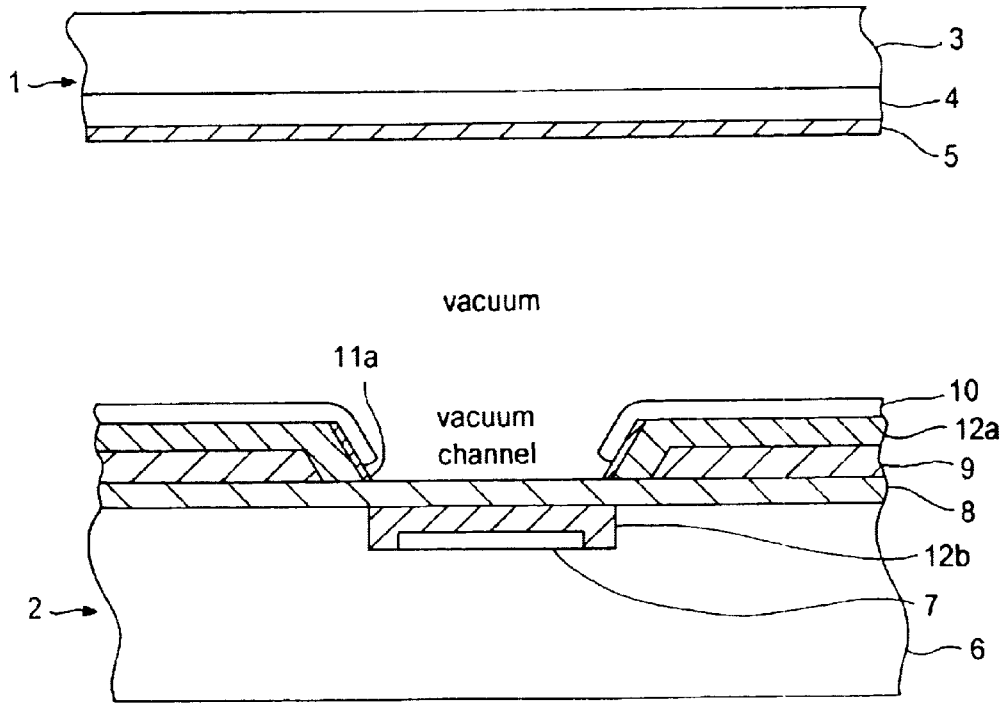
FIG. 5 illustrates an application of a resistance layer to a gate, based on the unit cell structure of FIG. 4.

There is no necessity for applying the resistance layer for the cathode only. Between a channel insulator 8 and a gate 7, as exemplified in FIG. 5, may be inserted a gate resistance layer 12*b*. In this case, a better enhancement in protecting cells upon shortage can be obtained than in the structure of FIG. 4.

Figure 6:
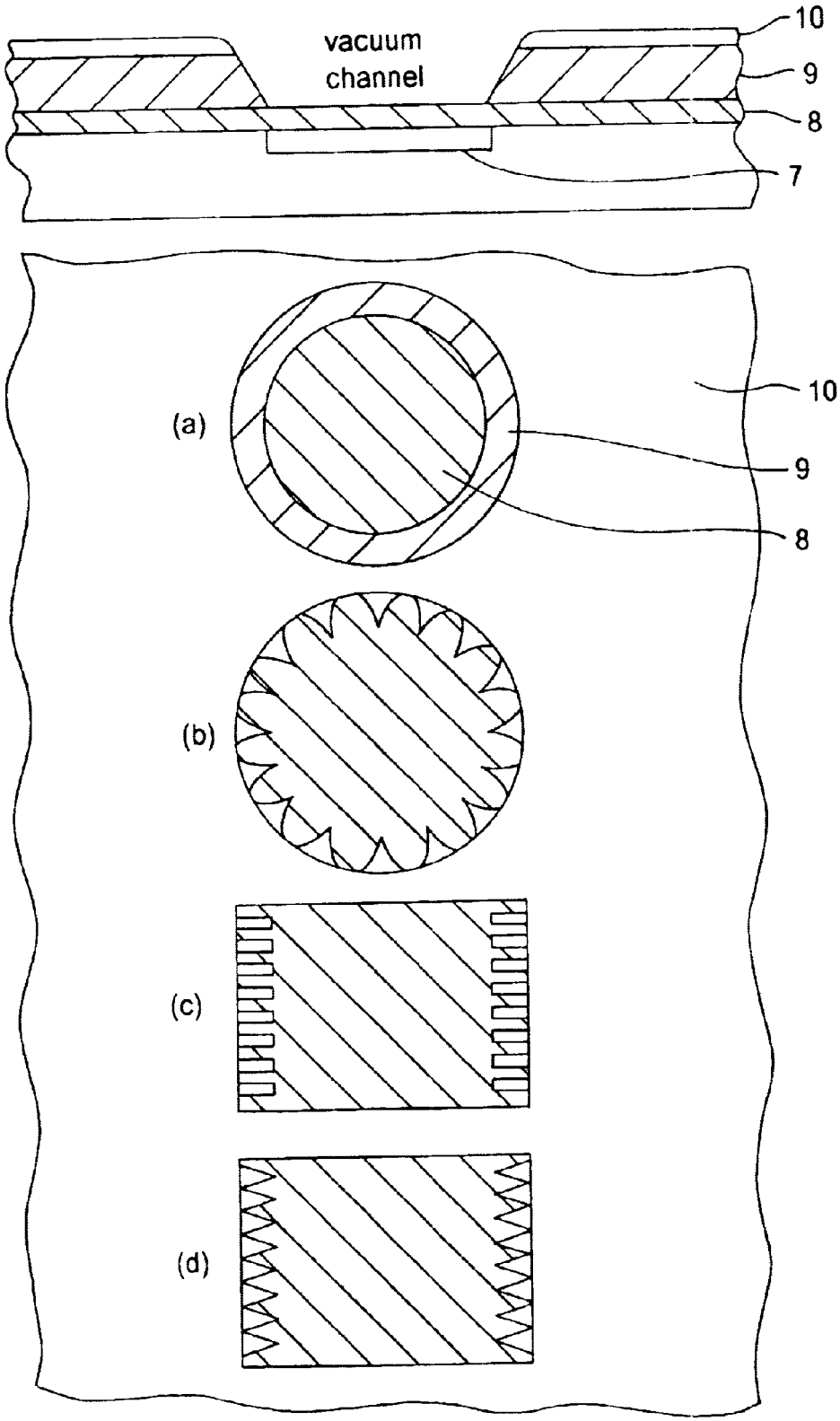
FIG. 6 illustrates cathode structures which adopt various shapes to increase the intensity of the electric field loaded on their edges, in a cross section view and in plan views.

Turning now to FIG. 6, there are cathodes which are formed into various shapes with the aim of increasing the electric field to obtain high discharge currents. The magnitude of the current discharged from the fringe of the cathode is a function of work function and field intensity. As the low work function is low or the electric field is intensive, the discharged current increases. Thus, under the application of the same voltage, the electric field becomes strong and the discharged current increases as the electron emission region of the cathode, e.g., the fringe of the cathode, is small in the radius of curvature. As seen in FIG. 6, since the unit cell of the present invention is of flat structure, the cathode electrode can be fabricated into various shapes, such as circles, pinnacles, polygonals, etc.

The present invention pertains, in principle, to the electron emission from a cathode into a vacuum. In order to deeply understand the invention, a detailed description will be given of the electron emission from a metal into a vacuum, below.

Electron emission from a metal to a vacuum is easily effected by an intensive electric field. In more detail, when applying a potent electric field on a metal, the height and width of a potential barrier on the metal surface are reduced, so as to allow the tunnel effect to take place easily. As large as $10^9$ [V/m] is required to emit electrons from metals to a vacuum. This is true of pure metals which range, in work function, from approximately 3 to 5 eV. However, particular metal compounds, or nonmetals, such as diamond or diamond-like carbon, show a work function as low as approximately 0.1–1 eV, allowing an electric current to flow with a similar rate under an electric field of $10^7$–$10^8$ [V/m]. In accordance with the present invention, these materials are utilized to effect the electron emission. Such materials as are low in work function are used as source materials or thinly coated on the source to give a KFED which can be operated at low voltages.

The current density of the electrons emitted from a metal to a vacuum follows the Fowler-Nordheim equation represented by the following mathematical equation I:

$$J = 1.54\ 10^{-6} \cdot \frac{E^2}{\Phi t(y)^2} \cdot e^{-6.83\times10^7 \times \frac{\Phi^{\frac{3}{2}} \times v(y)}{E}} \qquad \text{[I]}$$

wherein Φ is a potential difference corresponding to the work function of a metal, t(y) is an elliptic function in respect to the image force of the electrons emitted, v(y) is an elliptic function of nearly 1, and E is the intensity of the electric field applied on a metal surface. Occasionally, trivial protrusions may be on the metal surface. The current increase attributed to such protrusions is known to amount to hundreds to thousands times.

Returning to FIGS. 2*a*, 2*b* and 2*c*, the fundamental structures of the KFED according to the present invention allow the electrons emitted from the cathode to determine the electric currents. The quantity of emitted electrons depends on the intensity of the electric field at the vicinity of the boundary between the gate and the cathode and on the work function of the cathode metal. The intensity of the electric field around the fringe of the cathode electrode is a function of the potential applied across the cathode and the gate and a function of the thickness and dielectric constant of the channel insulator therebetween.

Hence, if the work function (qΦ) of the cathode and the intensity of the electric field are given, the current density (J) can be calculated from the mathematical equation I. As inferred from the equation, the recruitment of a material of a low work function for the cathode, the reduction of the curvature radius on the fringe of the cathode, and the increasing of the electric field by raising the voltage between the cathode and the gate, can give rise to an increase in the current density. Since the spacing between a cathode tip and a gate in a conventional FED corresponds to the thickness of the channel insulator of the KFED, a thin channel insulator is required to enhance the emission efficiency of electrons.

In a conventional FED, when the spacing between the cathode tip and the gate is set to be 1 μm or less, an arc discharge may take place between the cathode tip and the gate, breaking the electrodes. Thus, the distance between the two electrodes may be reduced within a limit. Another technique for augmenting the discharge current is to reduce the curvature radius of the pointed end of the cathode tip to increase the electric field intensity exerted. However, the reduction of the curvature radius is a very difficult process.

Consequently, conventional FEDs have a structural disadvantage of being incapable of obtaining a sufficient discharge current without increasing the gate voltage. High operation voltages for gates need high voltage operation ICS, raising the production cost and power consumption.

For the KFED, as described above, the channel insulator exists between the gate and the cathode, serving to prevent the arc discharge which is usual in conventional structures. Thus, the breakage of the gate is also prevented. In the present invention, the channel insulator is thin, so that electron emission can be effected at sufficiently lower gate voltages than those in conventional structures. This effect results in allowing the low power-low voltage operation ICs, fabricated by MOS processes, to be used in operating the KFED. Consequently, the KFED is cost-competitive.

In addition, when the channel insulator has a dielectric constant of $\epsilon_x$, the intensity E of the electric field in the vacuum channel region at which the channel insulator is brought into contact with the cathode, increases $\epsilon_x$ times. The intensity E of the electric field is further increased by the small curvature radius of the fringe of the cathode. Therefore, the FED of the present invention has a great current density (J).

If the cathode is made of tungsten (W) or molybdenum (Mo), its work function is approximately 4.5 eV, too large to give preferable current densities. On the other hand, where a low work function material, e.g., diamond or diamond-like carbon, is used for the cathode, a desirable current density can be attained even under very low electric fields. In consideration of the conductivity and processability of the low work function material, alternatively, the cathode is primarily made of a material good in conductivity and then, coated with the low work function material. Recently, there have been reported successes in stabilizing the electron emission and enhancing discharge properties through the surface coating of diamond or diamond-like carbon by virtue of its advantages of being low in work function, chemically stable, superior in thermal and electric conductivity, and stable in high temperature.

In the case of coating a low work function material on a cathode, problems attributable to the difference in work function between the two materials will be described, below. Also, a discussion will be given on the problems which may occur when the work function of the gate metal is different from that of the cathode metal. In addition, where the wire which connects the gate to the cathode has a different work function from those of the gate and cathode, the following description will contain the problems which may occur at such a junction between heterogeneous metals.

On the assumption that two metals, which are different in work function, make a junction with each other at different spacings with an insulator therebetween, where the spacings between the two metals are $d_{m1}$ and $d_{m2}$ respectively, if $d_{m1} << d_{m2}$, the work function difference between the two conductors is represented as follows: $q\Delta\Phi_m = q\Phi_{m1} - q\Phi_{m2}$ wherein $\Delta\Phi_m$ means the potential difference between the two metals. When the potential difference, $\Delta\Phi_m$, is produced across two metals with an insulator therebetween, a certain quantity of charges ($\pm\Delta Q$) exist at the interfaces between the two metals and the insulator while an electric field E is produced inside the insulator. Under this condition, when a voltage is externally applied across the two metals, electrons easily penetrate the insulator by virtue of the tunneling effect if the spacing is short, $d_{m1}$. On the other hand, the long spacing, $d_{m2}$, of the insulator makes it virtually impossible for the electrons to move through the insulator unless the voltage is extremely great.

Returning to FIGS. 2*a* to 2*c* with this situation in mind, the cathode metal is assumed to be connected to the gate metal via a wire. In the resulting structure, junctions between the cathode and the gate are shown in expanded views of FIG. 7. In the figure, it is assumed that the cathode, the gate and the wire all are aluminum and a part of the cathode is coated with a conductive, low work function material. Along the dotted line, a "source-junction 1-low work function material-junction 2-gate" structure is formed. That is, forming a close loop, two kinds of metals are connected to each other with two junctions therebetween.

Because the junction 1 has almost no spacing ($d_{m1} \approx 0$), the source is in direct contact with the gate. Therefore, though there exists a potential difference attributable to the different work functions between the two metals, electrons freely move between the two metals by virtue of the tunneling effect. This junction is called ohmic contact.

At the junction 2 between the low work function material and the gate, however, the tunneling effect cannot be expected and thus, the moving of electrons does not take place because, in contrast to the junction 1, the junction 2 has a great spacing ($d_{m1} << d_{m2}$). Nonetheless, between the low work function material and the gate is the potential difference corresponding to their work function difference. Thus, charges $\pm\Delta Q$ are at the respective interfaces of the insulator. Across the insulator, as shown in the expanded partial view of FIG. 7*a*, $+\Delta Q$ and $-\Delta Q$ exists at the side of the low work function material and at the side of the gate, respectively, making the internal electric field of the insulator be directed from the cathode toward the gate.

Having an inhibitory influence on the electron emission from the cathode, this direction of the electric field causes an offset voltage, which must be overcome when the element is intended to operate by applying a potential across the gate and the cathode. In order to reduce the threshold voltage, the metal for the gate must also be selected from materials of low work functions.

Figure 7A:
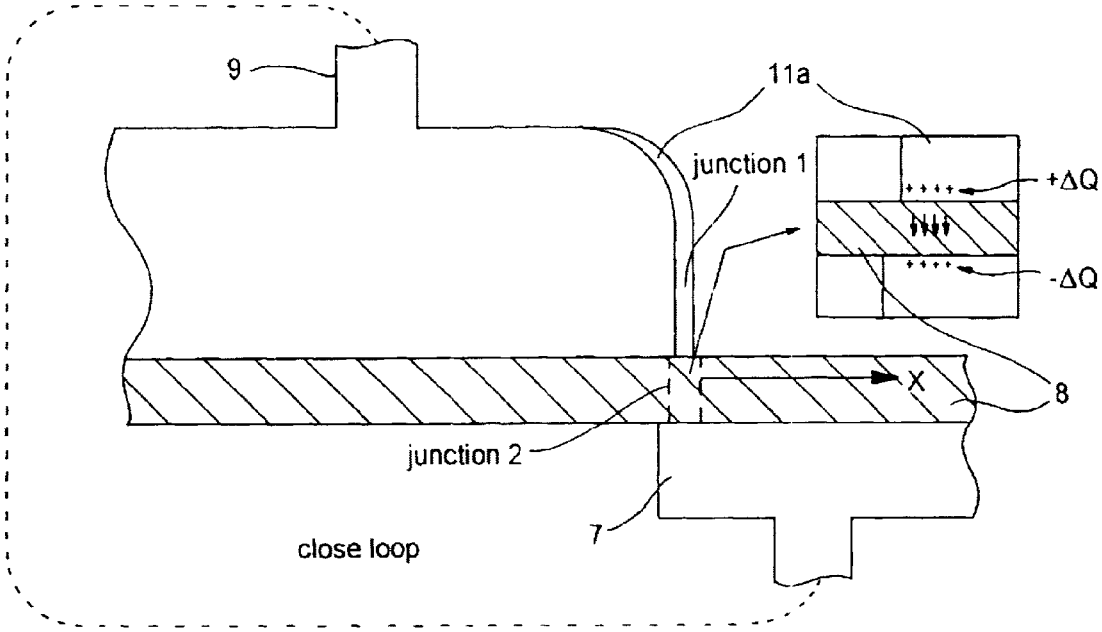
FIG. 7*a* shows a closed loop which is formed by connecting a gate to a cathode via a wire and the charges and electric fields which exist between metal junctions in a unit structure of a KFED.
Figure 7B:
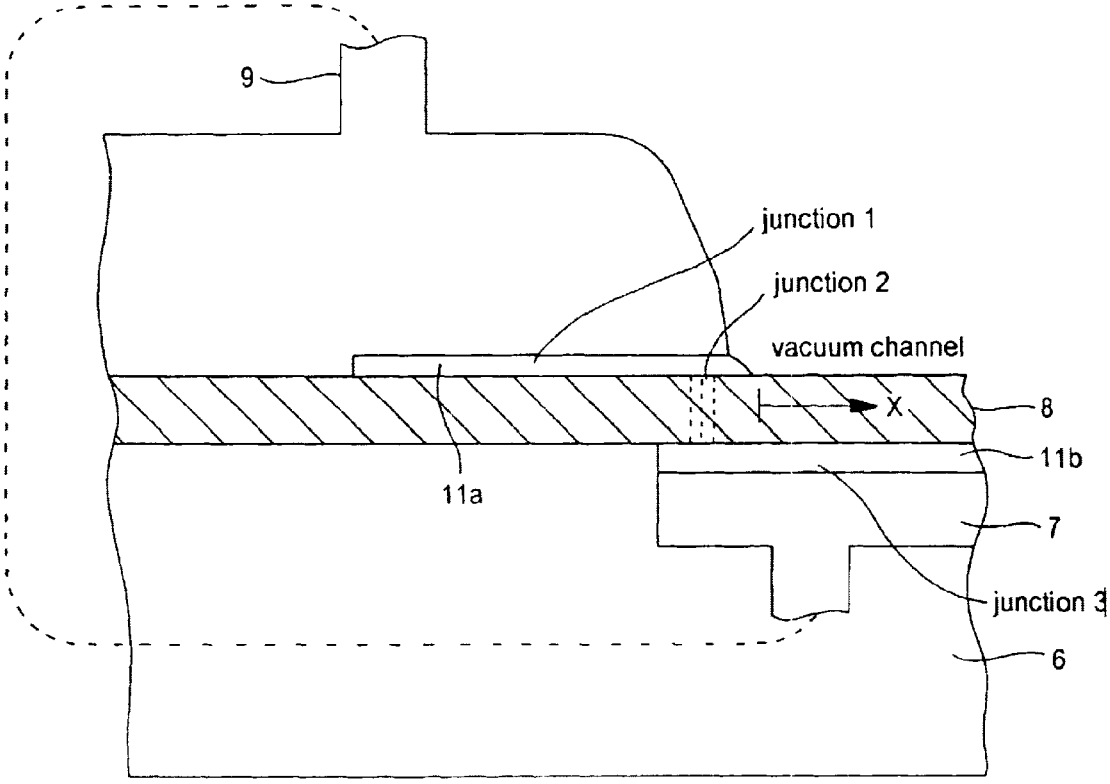
FIG. 7*b* shows an application of a low work function material to the interfaces between the cathode and the channel insulator and between the gate and the channel insulator in the unit structure of FIG. 7*a;*

Turning now to FIG. 7*b*, the same material (11*b*) as is coated on the side of the cathode, is used on the side of the gate to lower the offset voltage. In this structure, there no longer exists an offset voltage between the cathode and the gate because a junction 3 which is formed on the side of the gate S, is an ohmic contact, like the junction 1. In addition, the structure of FIG. 7*b* is characterized in that a low work function material is coded not on a cathode, but on a channel insulator and then, coated with conductor for a cathode. This structure is also operated in the same manner as described above.

Now, there will be discussed whether electrons can be emitted from the low work function material on the side of the cathode toward the channel. The direction toward the right channel is set as the X direction with the starting point at the end of the low work function material, as shown in FIGS. 7*a* and 7*b*. In order to transmit electrons at x=0 from the low work function material to the vacuum, the work function difference between the low work function material and the channel must be surmounted. Because the channel has a vacuum level, the problem is how the electrons surmount the work function of the low work function material itself. This is approached by applying a voltage across the gate and the cathode on the basis of the tunneling effect. If a potential difference exists between the gate and the cathode, the intensity of the internal electric field in the insulator is approximately determined from the formula E=V/d. In the x direction exists an electric field, called "fringing field". The intensity of the fringing field is maximal at the point x=0 and is weakened as it becomes distant from the source S (X>0).

Figure 8:
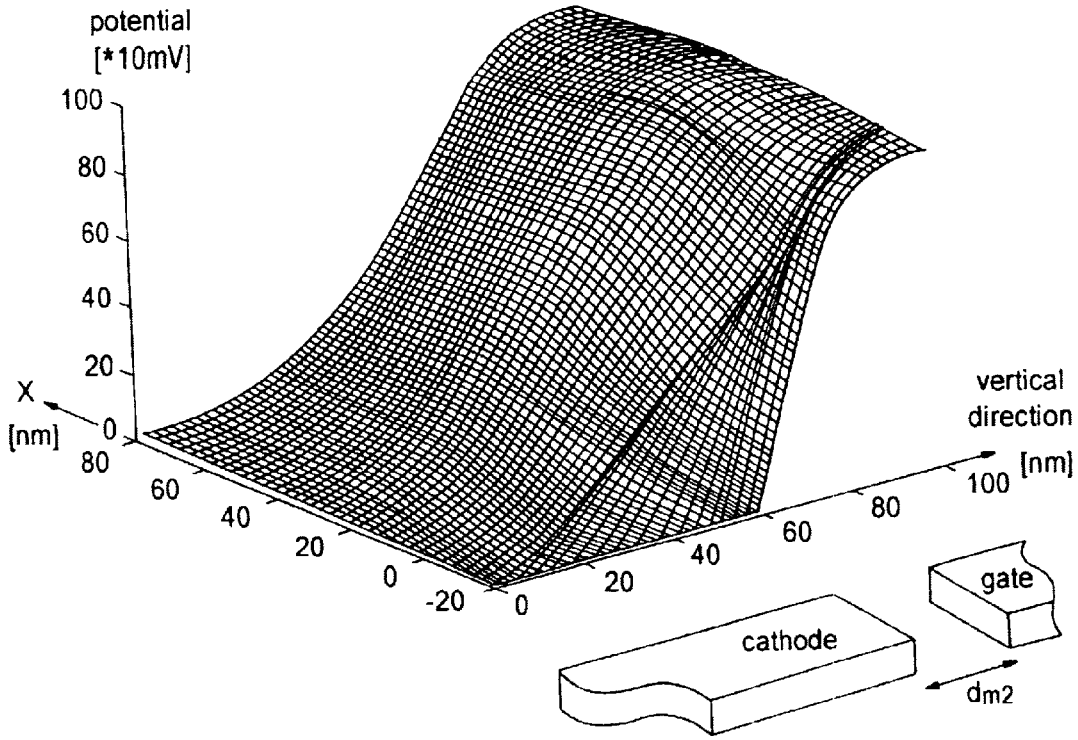
FIG. 8 is a simulation result for the potential change upon applying 1 volt across the gate and source in a unit structure of a KFED, obtained by a finite element method.

FIG. 8 is a view showing this tendency. In this figure, when 1 V is applied across the cathode and the gate on the assumption that the source and the gate are made of the same material with a spacing ($d_{m2}$) of 20 nm therebetween and a vacuum is used instead of the insulator, potential distributions are plotted against the distance on the x axis. The most important is the electric field intensity (the slope of the potential curve in the x direction) at the vicinity of x=0. It is recognized from the Fowler-Nordheim equation that the stronger this intensity is, the more the electrons are emitted.

The result of FIG. 8 was obtained, as aforementioned, by regarding as a vacuum the insulating layer between the cathode and the gate, but is quite different from the practice owing to the dielectric constant of the channel insulator. For instance, in the case of forming the insulator with $SiO_2$, because $SiO_2$ has a dielectric constant $\epsilon_r \approx 4$, the spacing $d_{m2}$ between the cathode and the gate must be extended by $\epsilon_r$ times, e.g. to 80 nm in order to provide the same magnitudes as in FIG. 8 to the electric field in the x direction under the same conditions as described above. Therefore, the intensity E of the electric field within the insulating layer $SiO_2$ is reduced to one quarter against the same voltage difference 1 V across the gate-source when the spacing $d_{m2}$ is extended by four times. Nonetheless, the electric flux density D remains unchanged because the electric flux density shows the relation $D=\epsilon_r\epsilon_o E$. Generally, the electric flux density D follows the path, the gate—the insulator—a partial vacuum channel—the source and becomes weak as the path penetrating through the vacuum is long. However, when considering the boundary condition on the fringe of the cathode, it is reasonable to understand that the electric flux density D on the fringe of vacuum channel which is in contact with the cathode is not quite different from that within the adjacent insulator. Thence, the electric field E is more intensified by approximately $\epsilon_r$ times on the fringe of the vacuum channel in contact with the cathode than within the adjacent insulator. In other words, the electric field E is the strongest on the fringe of the vacuum channel at the vicinity of the starting point x=0 and tends to be weakened as x is large.

In result, the electron emission from the low work Is function material on the side of the cathode is performed in such a way that electrons are emitted from the fringe (x=0) in contact with the channel into the fringe of the vacuum channel, at which the electric field is the most intensive. The emitted electrons are attracted by the potential applied to the gate, so as to accumulate on the insulating layer of the channel region. Under this circumstance, a part of the charges flow off by the action of the anode potential while the same quantity of charges are supplied from the cathode, thereby forming a current flow. As long as a considerably high voltage is not applied by the thickness of the insulating layer and the surface energy level formed on the insulating layer, the charges which are accumulated on the insulating layer of the channel as a result of the emission to the vacuum do not easily experience the tunneling toward the gate. Therefore, the voltage range which can be safely applied to the gate, is a function of the kind and thickness of the insulating layer.

The above description is responsible for a conductive low work function material-coated source S. For a non-conductive material coating, e.g. diamond or diamond like carbon coating, difficulty is given to the description of the ohmic contact. Even in this case, it was experimentally observed that the electron emission from the coated surface was also easily performed under a low electric field, as in the conductive coating case.

Figure 9A:
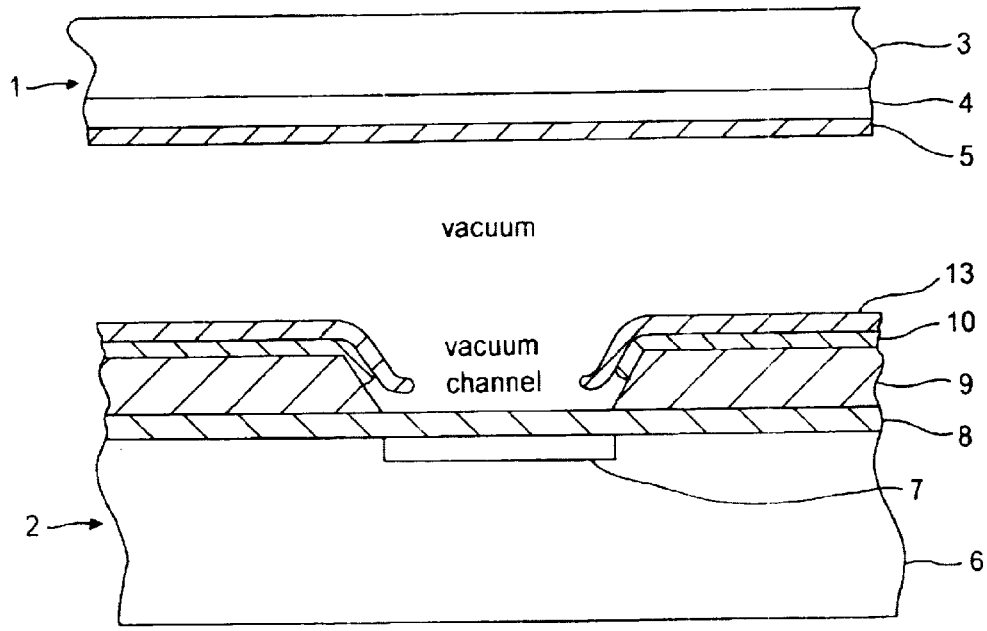
FIG. 9*a* illustrates a unit cell structure of a KFED, in which a protective gate is protruded out of a cathode electron emission spot so as to protect the emission spot from the high voltage exerted from the anode.
Figure 9B:
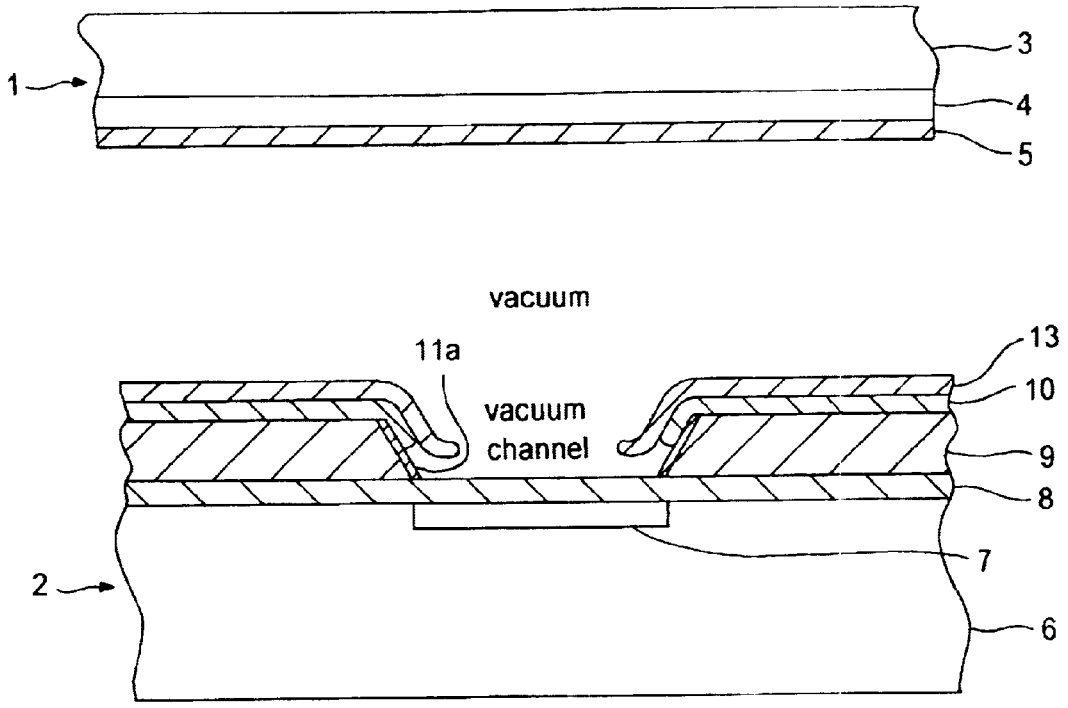
FIG. 9*b* illustrates an application of a low work function material to the cathode, based on the structure of FIG. 9*a;*
Figure 9C:
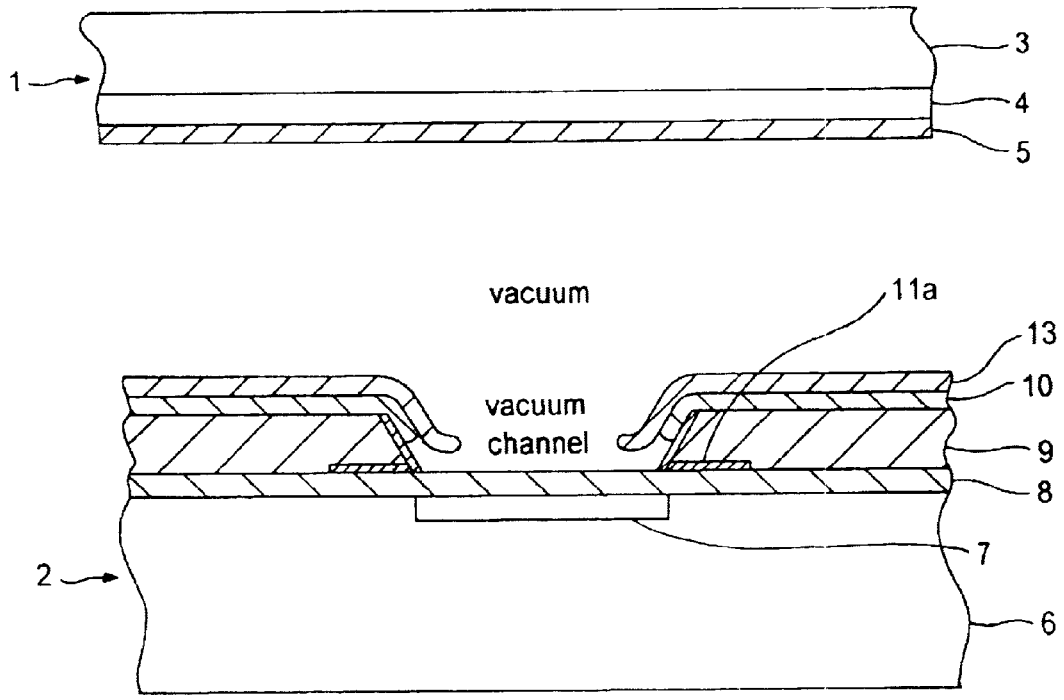
FIG. 9*c* illustrates an application of a resistance layer to the gate and the cathode, based on the structure of FIG. 9*b;*

Now, account will be taken of whether the gate can easily control an anode current which starts to flow when the electrons escaping from the cathode surface are driven by the electric field ruled by the anode voltage. The higher the voltage is applied to the anode, the greater the energy the accelerated electrons have. Moreover, use of a high voltage phosphor advantageously brings about an increase in luminescence efficiency. However, these high voltages are highly apt to cause a flashover phenomenon in conventional microtip type FEDs. Once flashover occurs, the cathode current in an electric conduction state is uncontrollable by gate voltages. In the structure of the present invention, this problem can be nearly surmounted as illustrated in FIG. 3.

Where the anode voltage is very high, the structures shown in FIGS. 9*a* to 9*c* are better than those illustrated in FIGS. 2*a* to 2*c* in an aspect of preventing the flashover phenomenon from occurring. Characterizing the structures of FIG. 9, a protective gate 13 is positioned atop the backing panel structure in which an insulator 10 is further formed over the backing panel structure of FIG. 2. The protective gate 13 is formed over the insulator 10 in such a manner that the protective gate 13 is protruded out of the cathode electron emission spot so as to protect the emission spot from the high voltage exerted from the anode. For these structures, the protective gate 13 is made of a metal with such a high work function that no electrons are emitted directly from the protective gate metal under the influence of the anode voltage.

Figure 10:
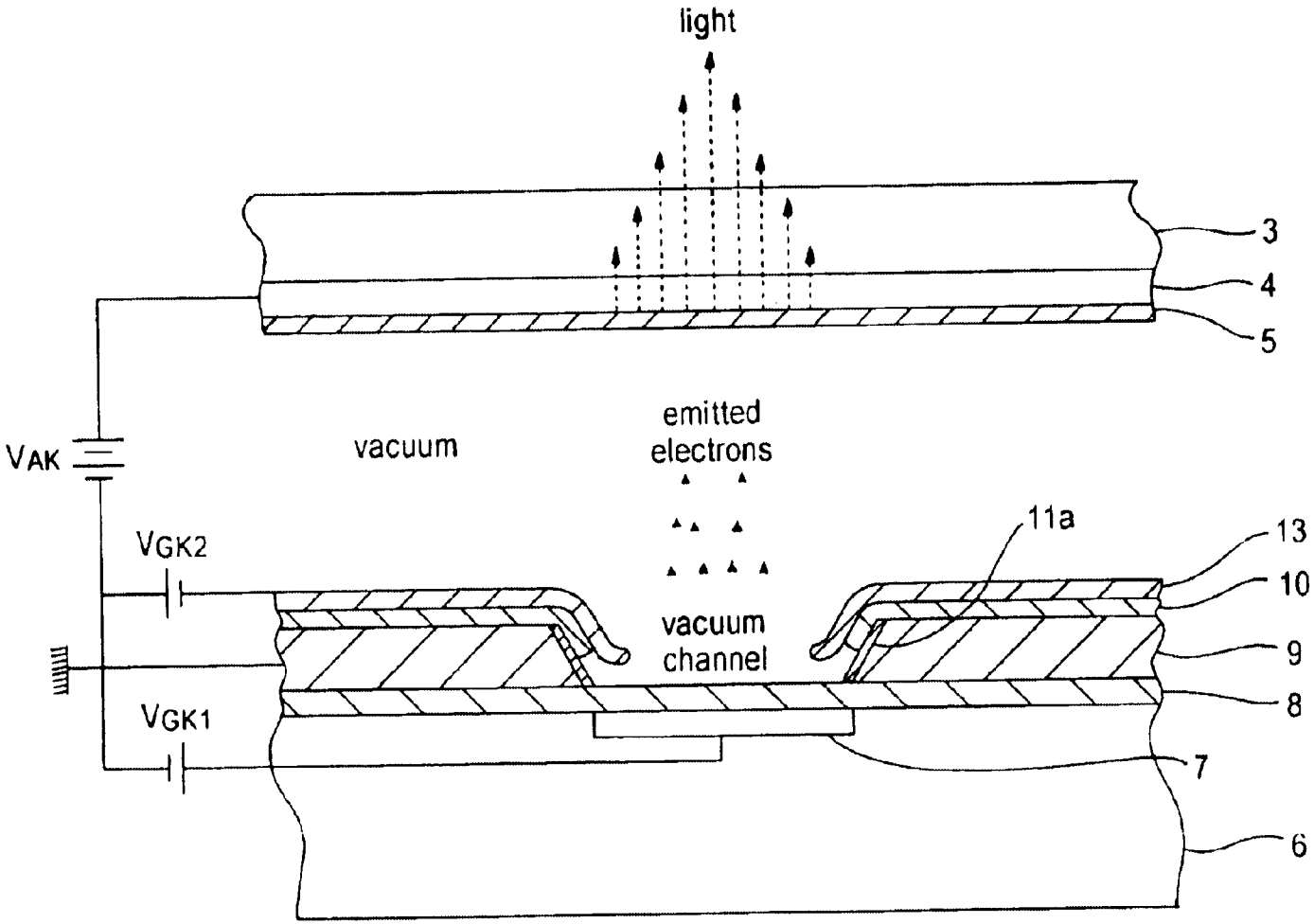
FIG. 10 illustrates the concept of the electron emission and luminescence in the unit cell structures of FIG. 9*b;*

With reference to FIG. 10, there is illustrated the operation for the protective gate-added structure of FIG. 9. Comparing with the operation of FIG. 3, this operation is characterized in that the protective gate 13 added is provided with a lower negative voltage, $V_{GK2}$, than is the cathode 9. By controlling the voltage applied to the protective gate 13, $V_{GK2}$, the low work function material 11*a* to the side of the cathode 9 can be shielded from the high voltage, $V_{AK}$, of the anode and it is possible to lower the surface field or maintain it at negative values. Therefore, the current on the side of the cathode can be controlled by the controlling gate, which leads to the prevention of flashover.

Below, the materialization of a plurality of pixels based on the unit cell structure of the FED according to the present invention will be described.

Figure 11A:
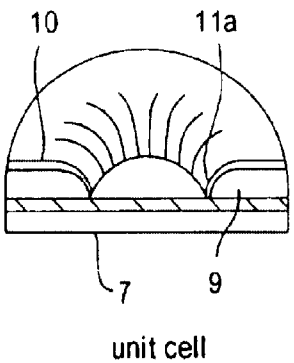
FIGS. 11 and 11(*a*) illustrate a structure of a double panel KFED in an aspect of pixels, along with an expanded view for its unit cell.
Figure 11:
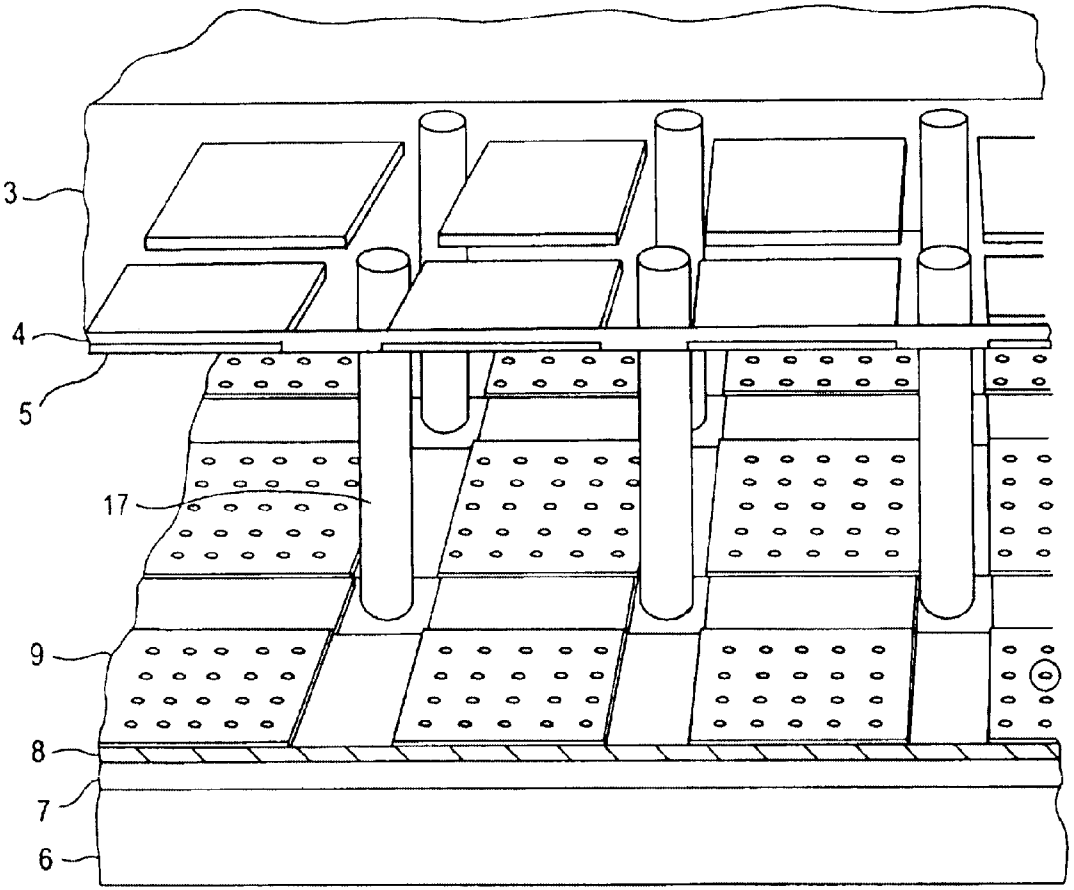

Referring to FIG. 11, there is a partial view for an entire flat panel FED of the present invention, along with an illustration for a unit cell. On a backing panel 6, such as a glass substrate, a silicon substrate or a metal plate, as seen in the figure, is formed a gate 7, followed by the formation of a channel insulator 8 on the gate 7. Dielectric breakdown must be taken into account in setting the thickness of the channel insulator 8. Using a semiconductor photolithography process or screen printing process, a cathode 9 is constructed on the channel insulator 8, and optionally coated with a resistance layer, as illustrated in FIG. 4, with the aim of restricting the maximal current possible in each unit cell. A low work function material is coated on the resistance layer to raise the electron emission efficiency. After the coating of the low work function material, an insulator is formed over the coating and overlaid by a protective gate to solve the problems attributable to the high voltage. In result, a backing panel structure is completed.

For the purpose of drawing a better electron emission effect from the interface at which the channel insulator 8 is in contact with the fringe of the cathode 9, the cathode fringe may be processed to have a minimal radius of curvature or formed into a structure suitable to intensify the electric field at the fringe, as seen in FIG. 6. In order to maintain the backing panel structure 6 at a distance apart from the front panel structure, the flat panel FED must be provided with spacers. Preferably, they have a mechanical strength enough to maintain the backing panel 6 and the front panel 3 at a predetermined distance apart. Other requirements are that they be fabricated thinly and lengthwise overextended and be superior in insulating property. Polyimide, known as an insulator in IC processes, may be used for the spacers. Apart from this, the materials which are available for conventional FEDs can also be used in the structures of the present invention. The spacers may be constructed into not only such a form as the supporting pillars 17 seen in FIG. 11, but also a septal wall such as that used in PDPs. In the latter case, after the septal walls are provided on the front panel structure and the backing panel structure, the front panel structure is joined to the backing panel structure by use of a screen printing method in such a way that their septal walls face to each other at a right angle. In result, one pixel is formed per cross point of the septal walls.

As for the constitution of the front panel 3, it starts with the formation of a thin transparent conductive film, consisting of indium tin oxide (ITO), on, e.g. a glass substrate. This transparent conductive film (ITO) is used as the anode electrode 4 and allows the light generated by the phosphor 5 to pass therethrough. As in PDPs, bus electrodes with the aim of easily collecting currents may be established on the transparent conductive anode in an array which does not have influence on the representation of images at all. The phosphor 5, which will be coated on the transparent conductive film, may be selected from a high voltage type and a low voltage type, taking sufficient account of operation voltage, current, and luminescence efficiency.

When the emitted electrons are accelerated by the anode electric field to collide against the phosphor 5, visible light is generated and passes through the transparent conductive film anode 4 and the front panel 3. To express colors, three phosphors, each emitting red, yellow or green light, are properly coated on the transparent conductive film. Desired colors can be realized at desired pixels by controlling the voltages loaded on the gate 7 and the cathode 9. Where it is difficult to embody a color with the spontaneous luminescence of the phosphors, there may be adopted a structure in which a phosphor of white light is used and color filters are arranged on the transparent conductive film of the front panel to separate the three colors from the phosphor of white color. A high vacuum must be maintained between the front panel 3 and the backing panel 6, so as for the emitted electrons from the cathode to avoid colliding with air molecules until they reach the phosphors on the front panel.

Figure 12A:
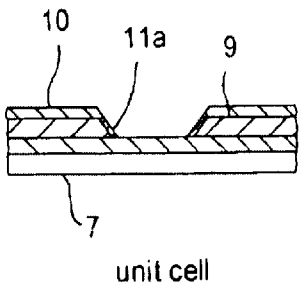
FIGS. 12 and 12(*a*) illustrate a structure of a double panel KFED in which cathodes are of stripe form, in an aspect of pixels.
Figure 12:
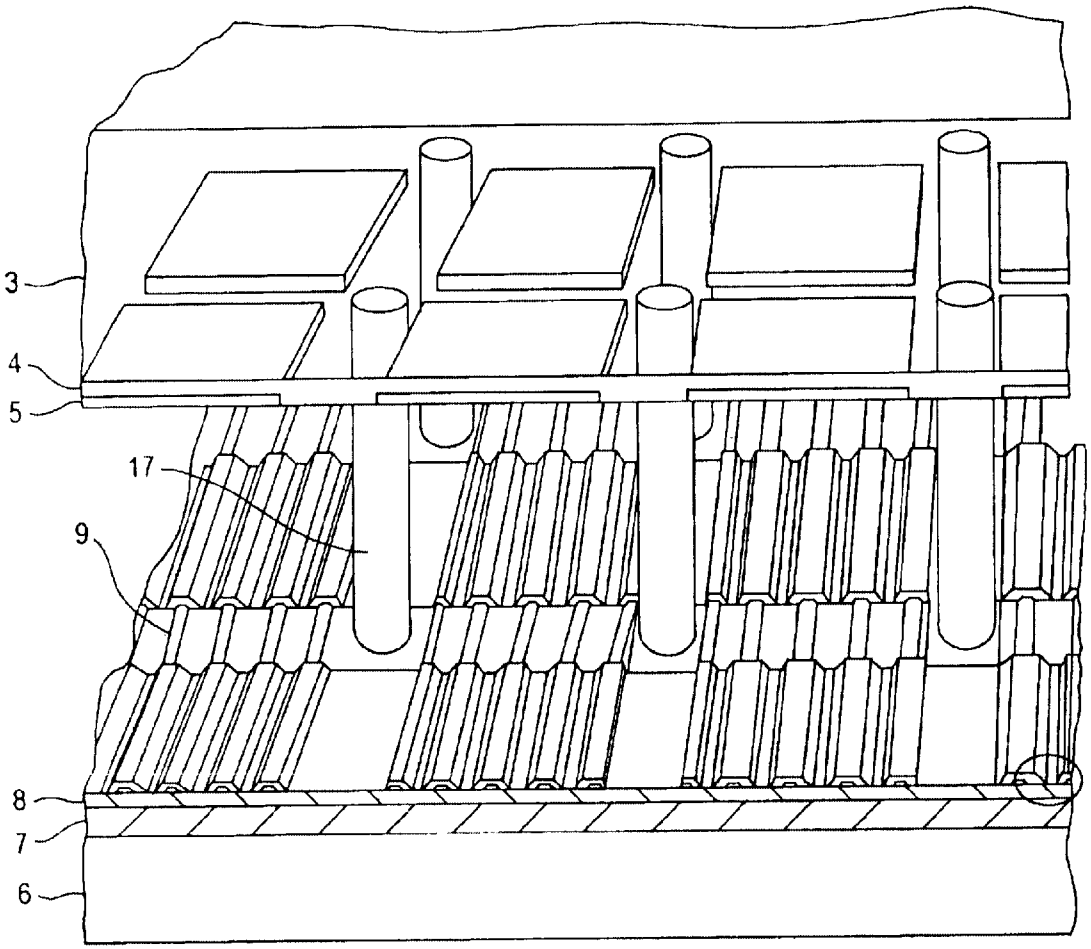

With reference to FIG. 12, cathodes with a stripe form are suggested, compared with the cathodes in FIG. 11. The stripe form may be replaced with the toothed form of a comb shown in FIG. 13*b*. With a fundamental similarity with the cell structure of FIG. 11, the cell structure of the stripe form is illustrated in an expanded view in FIG. 12. On a gate electrode 7 is deposited a channel insulator 8 over which a cathode 9, a low work function material 11*a* and an insulating protective film 10 are sequentially formed. If necessary, a protective gate may be further provided. The electrons are emitted from the side of the low work function material 11*a*, at which the low work function material is in contact with the gate 7 with the channel insulator 8 therebetween. As in the structure of FIG. 11, this electron emission spot is widely distributed. Apart from the structures of FIGS. 11 and 12, other different flat panel FED structures can be constructed to adopt such various cathode forms as shown in FIG. 6, depending on material properties, voltages applied, etc.

Figure 13:
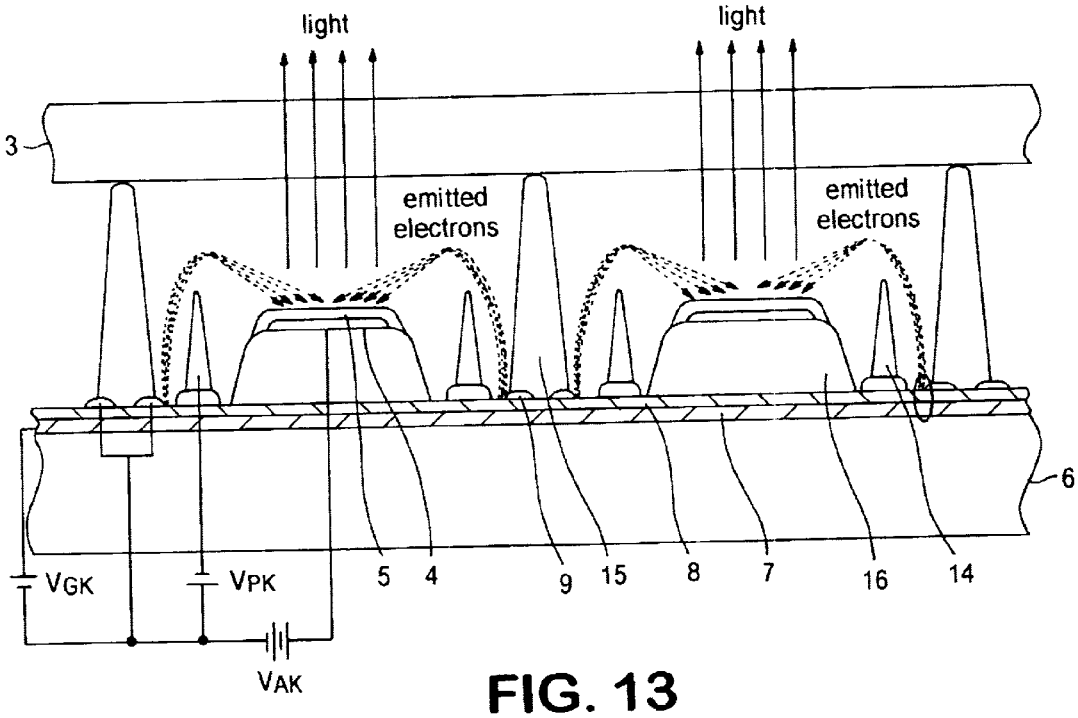
FIGS. 13 and 13(*a*) through 13(*c*) illustrate the concept of the electron emission and luminescence in an integrated type KFED.
Figure 13A:
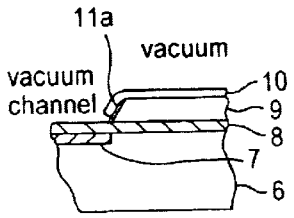
Figure 13B:
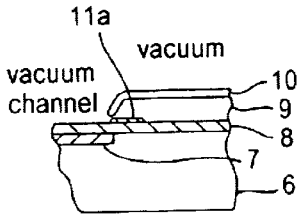
Figure 13C:
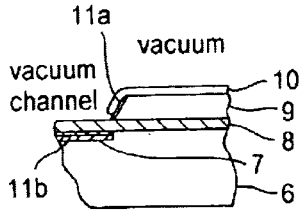
Figure 14:
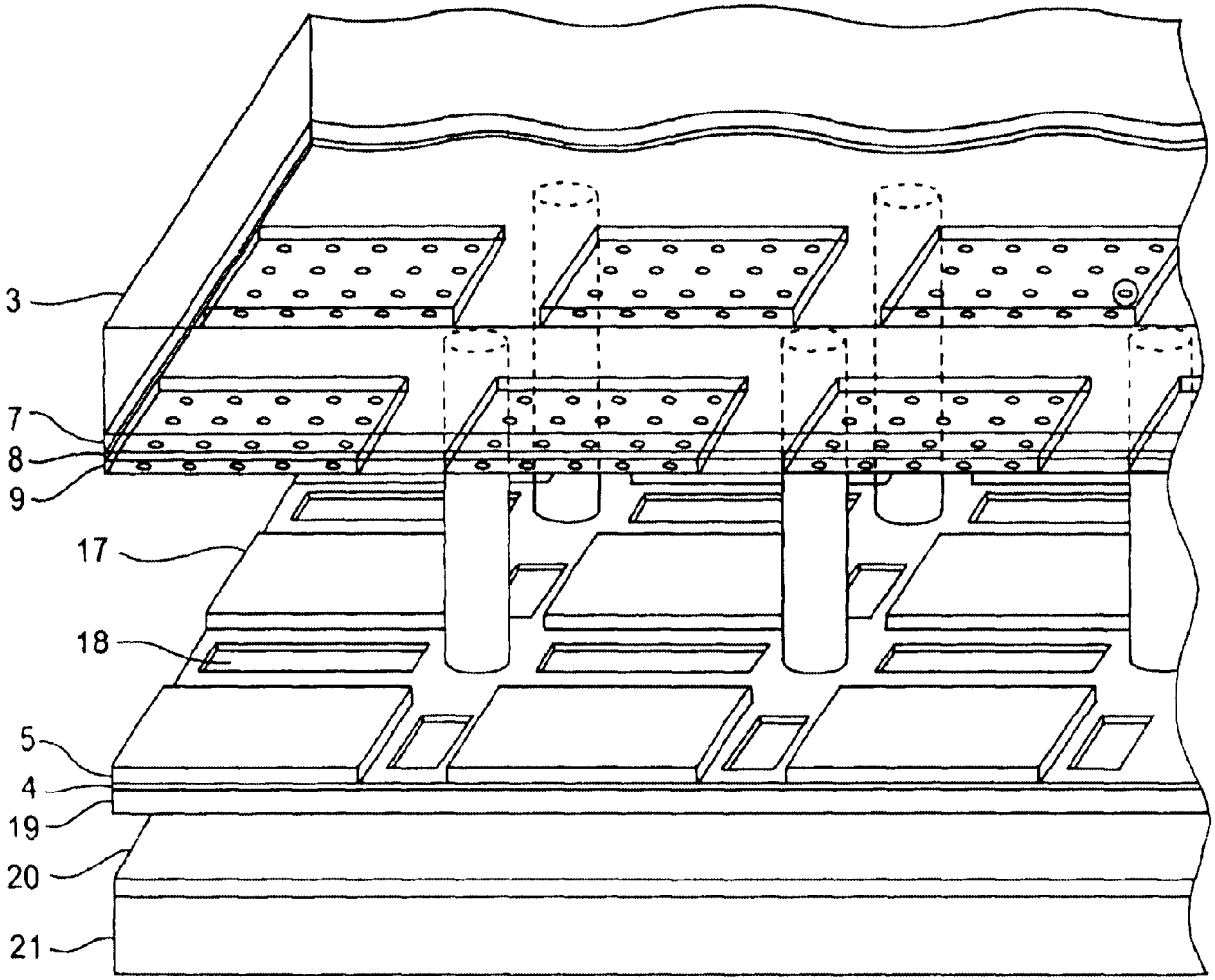
FIGS. 14 and 14(*a*) through 14 (*e*) illustrate a structure of a reflective type KFED, in an aspect of pixels.
Figure 14A:
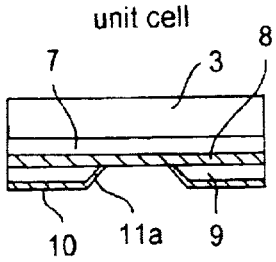
Figure 14B:
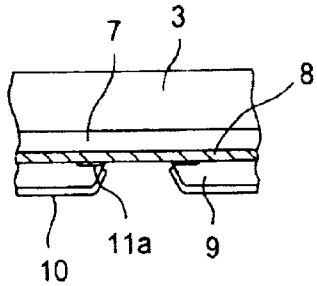
Figure 14C:
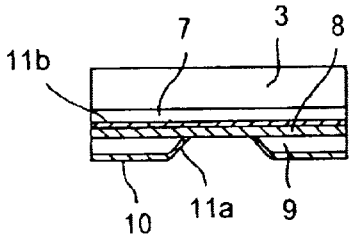
Figure 14D:
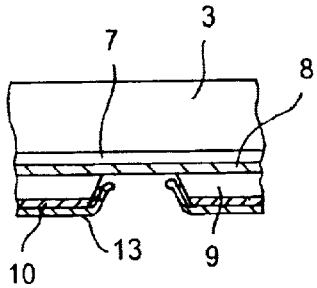
Figure 14E:
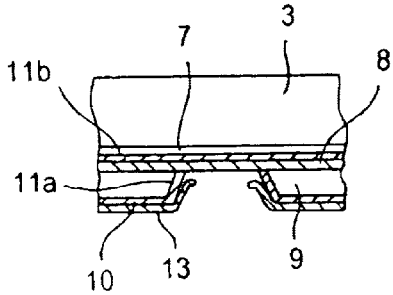

The flat panel FEDs of the present invention can be divided into three types by structural constitutions: a double panel type such as those shown in FIGS. 11 and 12, consisting of a front panel provided with anodes and phosphors and a backing panel provided with cathodes and gates; an integrated type such as the structures of FIGS. 13*a* and 13*b*, in which cathodes, gates and phosphor-coated anodes are formed on the same panel; and a reflective type such as the structure of FIG. 14, consisting of a front panel provided with cathodes and gates, an intermediate panel provided with phosphors and anodes, and a rear panel provided with getters.

Unlike the structures of FIGS. 11 and 12 in which the components are dispersed over a front panel and a backing panel, the structures of FIGS. 13*a* and 13*b* are characterized in that all electrodes and phosphors are formed on a backing panel. They are discriminately called a double panel type and an integrated type, respectively. The integrated type structure is equal to the double panel type structure in unit cell structure and electron emission principle. FIG. 13*a* shows two unit cell structures of integrated type. As shown in this cross section, each cell is isolated by insulating septal walls 15. These insulating septal walls can be established by a screen printing process. In place of these septal walls, the insulating supporting pillars, as shown in FIGS. 11 and 12, may be used. On the septal walls or the insulating supporting pillars is overlaid a transparent glass front panel 3 through which the emitted light from the phosphors pass. Since the transparent front panel 3 passes only the light generated from the phosphors 5, if its mechanical strength and optical transmittivity are properly maintained, the structure can be fabricated easily without the aid of particular processes.

On a backing panel 6, a gate 7 and a channel insulator 8 are stacked, followed by positioning cathodes 9 at opposite verges of unit cells on the channel insulator 8. On the middle of a unit cell, a thick insulating support 16 for an anode is constructed, after which an anode 4 coated with a phosphor 5 is placed on the support 16. As in the double panel type, a selective region of the cathode 9, from which electrons are to be emitted, may be subjected to surface treatment to lower its work function. Alternatively, a low work function material is coated on the selective region.

With reference to FIG. 13*b*, there are shown cathodes with the toothed form of a comb. In this case, because the teeth have small curvature radii at their ends, the majority of electrons are emitted from the ends, so that the emission efficiency is much improved. By virtue of this effect, if the cathode adopts the toothed form of a comb, the surface treatment or the coating of a low work material may be omitted. With a position between the cathode and the anode, a protecting and polarizing gate 14 is laid on a thick insulating layer which is previously provided on the channel insulator 8. Functioning to prevent the cathode flashover attributable to the high voltage of the anode, the protecting and polarizing gate 14, made of a metal, is taller than the anode support 16, but lower than the insulator septal walls or insulating supporting pillars, as shown in FIG. 13*a*. Owing to the presence of the protecting and polarizing gate 14, electrons move from the cathode to the anode along the curved track. Because the phosphor is coated on the upper surface of the anode, the electrons collide to the phosphor to emit light. The anode 4, positioned between the protecting and polarizing gates 14, is flatly formed on the relatively thick anode support 16. This is to sufficiently insulate the anode 4 applied with high voltages from the anode support 16.

With reference to FIG. 13*a*, there is illustrated the operation of the integrated type FED of the present invention. As in the double panel type FED, when a voltage ($V_{GK}$) is applied across the gate 7 and the cathode 9, an electric field is formed through the channel insulator 8, inciting a tunneling effect to emit electrons from the fringe of the low work function material-coated side of the cathode to the vacuum. The electrons emitted are led by the voltage ($V_{AK}$) loaded between the anode positioned at the verge of the cell and the cathode positioned at the middle of the cell.

At this time, the protecting and polarizing gate 14 enables the voltage of the cathode to be controlled to negative or positive values ($V_{PK}$), functioning to protect the cathode from the high voltage of the anode. Because the protecting and polarizing gate 14 is taller than the anode 4, the electrons emitted are accelerated on a curved track by the electric field exerting its influence on the electron emission spot of the cathode to collide against the phosphor coated on the anode 4.

The insulating layer beneath the protecting and polarizing gate 14 serves to restrain unnecessary electron emission which may occur from the insulator owing to the difference between the gate voltage ($V_{GK}$) and the protecting and polarizing gate voltage ($V_{PK}$).

With reference to FIG. 13*b*, the integrated type FED of FIG. 13*a* is shown in a front view. As seen, columns appear by the division of the insulating septal walls while rows are formed by the arrangement of the gates beneath the insulator. The gates 7 are found to be lengthwise over extended particularly beneath the cathodes 9. This aims at the condition under which an electric field is focused on the fringes of the cathodes 9 while unnecessary capacitance at other regions is reduced. As seen in FIG. 13*a*, the cells are divided by insulating septal walls 15 while a cathode 9 is positioned near the insulating septal wall 15, an anode 4 at the middle region, and a protecting and polarizing gate between the insulating Septal wall. The above-described integrated type in which all elements are arranged on one panel has an advantage over the double panel type in which an anode and a cathode are each provided on individual panels, in an aspect of production and assembly.

With reference to FIG. 14, there is a reflective type flat panel FED according to the present invention.

In a cell of this structure, a cathode 9 and a gate 7 are formed as transparent on a front panel 3 so that the luminescence of a phosphor 5 is visible through the front panel 3. An anode 4, made of a metal of high. reflectivity, such as aluminum, is provided on an intermediate panel 19 and coated with a phosphor 5. Between the phosphor-coated regions are established many apertures 18 through which the gas molecules generated owing to the luminescence of the phosphor freely pass. A porous getter 20 is positioned on a rear panel 21 to fast absorb the gas molecules approached through the apertures 18.

In the double panel type of FIGS. 11 and 12, some of the light emitted by the luminescence of the phosphors comes out of the display through the front panel while the remaining light is directed toward the inside of the display. Thus, only half of the light generated in practice, gives the visual effect on a double panel type display. On the other hand, in the reflective type structure of FIG. 14, the light resulting from the luminescence of the phosphors is directed to the front panel or reflected by the anode metal, such as aluminum, so that almost all of the light generated comes out of the display through the front panel. That is, this reflective type structure has a luminescence efficiency twice as high as that of the double panel type structures. The same intensity of the light with the double panel FED can be obtained by reducing the number of the electrons colliding against the phosphor into half or reducing the anode voltage to lower the energy of the electrons colliding against the phosphor. Therefore, this reflective type structure can be operated at low anode voltages and thus, are very advantageous for low voltage FED.

In order to show stable electron emission properties, FEDs are maintained at a high vacuum level. For this, a getter which well absorbs gas materials, is provided inside the reflective type structure. While the double panel type or integrated type structures illustrated in FIGS. 11, 12 and 13*a* cannot employ a getter near the phosphor, the reflective type structure of FIG. 14 utilizes a getter to capture the gas molecules generated upon luminescence. This is possible because the gas molecules freely travel from the front panel through the apertures in the intermediate panel to the rear panel provided with the getter. Consequently, the reflective type structure is more advantageous in that it is able to be maintained at high vacuum level more easily than other type structures.

As described hereinbefore, the flat panel FEDs of the present invention (KFEDs) can be much more easily fabricated than conventional microtip type FEDs because conventional semiconductor fabrication processes, as they are, can be utilized, along with the widely known screen printing technique. Particularly, because the KFEDs adopt planar structures which require no highly precise processes, facility investment cost is not great and a high production yield is expected.

In addition, the KFEDs can realize images of high definition and represent all natural colors with a high resolution.

In contrast to LCDs, the KFEDs show spontaneous luminescence. Further, the KFEDs allow large screen area thin panels with wide view angles, which are much lighter than conventional CRTs. Also, the KFEDs show fast response properties and are superior in energy efficiency due to low power consumption. Therefore, it is expected that the present invention can be applied for image displays with innovative effects.

The present invention has been described in an illustrative manner, and it is to be understood the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A double panel type flat field emitter display, consisting of a plurality of unit cells, each of the cells comprising:

a front panel structure in which an anode is formed on a transparent front panel and coated with a phosphor; and a backing panel structure in which a cathode and a gate are formed on and beneath a channel insulator, respectively, underlaid by a backing panel, wherein the gate is configured to apply a voltage across the gate and the cathode, the cathode is covered with an insulating protective film and a protective gate, sequentially, in such a way that the protective gate is protruded toward a vacuum channel so that the edge of the protective gate is positioned above the cathode surface exposed to the vacuum channel, thereby protecting the emission spot from the high voltage exerted from the anode, the front panel structure being joined to the backing panel structure in a vacuum condition in such a way that the phosphor faces toward the cathode, wherein a low voltage is applied between the gate formed beneath the channel insulator and the cathode to emit electrons from a spot at which the fringe of the cathode is in contact with the channel insulator, to the vacuum channel, and a high voltage is applied to the anode to accelerate the emitted electrons and finally to collide them against the phosphor to luminesce, said emitted electrons being controlled in number by the voltage between the gate and cathode, said cells being arranged in a pattern to form a pixel which represents information.

2. A double panel type flat field emitter display as set forth in claim 1, wherein an exposed surface of said cathode to the vacuum channel is coated with a low work function material.

3. A double panel type flat field emitter display as set forth in claim 1, wherein a low work function material is applied between the cathode and the channel insulator.

4. A double panel type flat field emitter display as set forth in claim 1, wherein a low work function material is applied between the gate and the channel insulator, so as to reduce an offset voltage against the applied voltage between the gate and the cathode.

5. An integrated type field emitter display, consisting of a plurality of unit cells, each of the cells comprising:

a transparent front panel;

a gate formed on a backing panel;

a channel insulator formed on the gate;

an insulating anode support with a predetermined width and thickness, formed on the channel insulator;

an anode formed on the anode support;

a phosphor coated on the anode;

protecting and polarizing gates which stand opposite to each other with the anode at the center, said gates consisting of conductors with a septal structure and being taller than the anode;

an insulating layer with a thickness, formed between the protecting and polarizing gate and the channel insulator; and a cathode which stands opposite to the anode on the channel insulator with the protecting and polarizing gate being between the cathode and the anode, said cells being isolated from each other by insulating septal walls taller than the protecting and polarizing gate, which stand between the protecting and polarizing gates on the channel insulator with a symmetric arrangement, overlapping the cathode, and form vacuum channels together with the front panel and the backing panel, wherein a voltage is applied between the gate and the anode to emit electrons from the cathode, said emitted electrons traveling around the protecting and polarizing gate along a curved track to collide against the phosphor to emit light which passes through the front panel.

6. An integrated type flat field emitter display as set forth in claim 5, wherein an exposed surface of said cathode to the vacuum channel is coated with a low work function material.

7. An integrated type flat field emitter display as set forth in claim 5, wherein a low work function material is applied between the cathode and the channel insulator.

8. An integrated type flat field emitter display as set forth in claim 6, wherein a low work function material is applied between the gate and the channel insulator, so as to reduce an offset voltage against the applied voltage between the gate and the cathode.

9. A reflective type flat field emitter display, consisting of a plurality of unit cells, each of the cells comprising:

a front panel structure comprising:

a transparent gate beneath a front panel;

a transparent channel insulator beneath the gate;

a transparent cathode for electron emission, formed beneath the channel insulator; and an insulating protective film formed beneath the cathode;

a backing panel structure comprising:

an anode formed of a high reflective metal on a backing panel; and a phosphor coated on the anode, said front panel structure being joined to said backing panel structure in such a way that the cathode faces toward the anode and a vacuum channel space is formed by separating the two panel structures at a distance apart with the aid of supporting pillars, said cells being arranged in a pattern to form a pixel which represents information, wherein electrons are emitted from the cathode and collide against the phosphor to generate light which passes through the transparent cathode electrode, the transparent channel insulator and the transparent gate, thereby representing images.

10. A reflective type flat field emitter display as set forth in claim 9, wherein the exposed surface of said cathode to the vacuum channel is coated with a low work function material.

11. A reflective type flat field emitter display as set forth in claim 9, wherein a low work function material is applied between the cathode and the channel insulator.

12. A reflective type flat field emitter display as set forth in claim 10, wherein a low work function material is applied between the gate and the channel insulator, so as to reduce an offset voltage against the applied voltage between the gate and the cathode.

13. A reflective type flat field emitter display as set forth in claim 9, wherein the insulating protective film is underlaid by a protective gate in such a way that the protective gate is protruded toward the vacuum channel out of a cathode electron emission spot to give a space below the channel insulator, thereby protecting the emission spot from the high voltage exerted from the anode.

14. A reflective type flat field emitter display as set forth in claim 12, wherein the insulating protective film is underlaid by a protective gate, sequentially, in such a way that the protective gate is protruded toward the vacuum channel out of a cathode electron emission spot to give a space below the channel insulator, thereby protecting the emission spot from the high voltage exerted from the anode.

* * * * *